US006041489A

United States Patent [19]

Neven

[11] Patent Number: 6,041,489

[45] Date of Patent: Mar. 28, 2000

[54] METHOD OF MANUFACTURING AN ELECTROMAGNETIC RELAY

[75] Inventor: Lucas Neven, Tongeren, Belgium

[73] Assignee: C. P. Clare Corporation, Beverly, Mass.

[21] Appl. No.: 08/813,824

[22] Filed: Mar. 6, 1997

Related U.S. Application Data

[62] Division of application No. 08/643,005, May 3, 1996, abandoned.

[30] Foreign Application Priority Data

Apr. 30, 1996 [EP] European Pat. Off. ..... 92201193

[51] Int. Cl.[7] ..... H01F 41/06

[52] U.S. Cl. ..... 29/605; 335/154

[58] Field of Search ..... 29/602.1, 605; 335/151–154

[56] References Cited

U.S. PATENT DOCUMENTS

| | | | |
|---|---|---|---|
| 3,928,829 | 12/1975 | Abrams | 335/151 |
| 3,958,199 | 5/1976 | Sietz, Jr. et al. | 335/154 |
| 4,063,205 | 12/1977 | Miknaitis | 335/202 |
| 4,136,321 | 1/1979 | Smith | 335/151 |
| 4,145,805 | 3/1979 | Smith | 29/605 |
| 4,177,439 | 12/1979 | Smith | 335/151 |
| 4,232,281 | 11/1980 | Smith | 335/152 |
| 4,243,963 | 1/1981 | Jameel et al. | 335/151 |
| 4,752,754 | 6/1988 | Strauss | 335/151 |
| 4,769,622 | 9/1988 | Leavitt | 335/154 |
| 5,258,731 | 11/1993 | Zemke | 335/4 |
| 5,438,307 | 8/1995 | Chou | 335/151 |

FOREIGN PATENT DOCUMENTS

| | | |
|---|---|---|
| 0 345 954 | 5/1989 | European Pat. Off. . |
| 6923365 | 12/1968 | Germany . |

OTHER PUBLICATIONS

European Search Report.

*Primary Examiner*—Carl E. Hall
*Attorney, Agent, or Firm*—McDermott, Will & Emery

[57] ABSTRACT

A method for fabricating a reed relay which includes a magnetically actuated switch and a bobbin. The switch defines an exterior surface and includes two terminals, and the switch provides a relatively low electrical resistance path between the two terminals when closed and provides a relatively high electrical resistance path between the two terminals when open. The bobbin defines an interior surface and an exterior surface, and the bobbin is disposed around the switch so that the bobbin interior surface contacts substantially all of a predetermined portion of the switch exterior surface.

8 Claims, 7 Drawing Sheets

METHOD OF MANUFACTURING AN ELECTROMAGNETIC RELAY

This application is a division of application Ser. No. 08/643,005, filed May 3, 1996, now abandoned.

FIELD OF THE INVENTION

The present invention relates generally to electromagnetic or reed relays switches, and more particularly to a method of manufacturing such relay devices.

BACKGROUND OF THE INVENTION

A reed relay consists of a switching device (such as the one described in U.S. Pat. No. 4,769,622), which can be a dry reed or mercury wetted switch, and an energizing coil for generating a magnetic field around the magnetic conducting parts of the switch and thereby generating a magnetic force for selectively opening and closing the switch. The coil is wound on a hollow tubular bobbin that defines a central aperture and is open at both ends, thereby allowing the switch to be introduced into the aperture of the bobbin. A thermoset material is then moulded around the coil-bobbin-switch assembly, or the assembly may be embedded in a potting compound such as polyurethane for fabricating the completed reed relay part.

During the moulding or embedding process, the thermoset material or potting compound flows through the bobbin's central aperture and directly contacts the switching device. Since the coefficient of thermal expansion for the thermoset material or the potting compound does not match the coefficient for the switching device (i.e., the coefficient of thermal expansion for the glass envelope that typically hermetically seals the conductive elements of the switching device), a change in temperature occurring at any time during the life span of the reed relay can cause thermal stresses that adversely affect the reed relay's performance. Such temperature changes and their resulting thermal stresses can occur during shipping, during installation (e.g., while soldering a reed relay onto a printed circuit board), or during operation of the reed relay occurring as a result of fluctuations in the ambient temperature. The thermal stresses resulting from such temperature changes can adversely affect the reed relay's operating characteristics such as its contact resistance (i.e., the electrical resistance between both ends of the switching device when closed) or its operate and release voltages (i.e., the voltages applied to the coils to open and close the switching device), and can also cause glass cracking, glass breakage, and failure of the reed relay.

One method of remedying some of these deficiencies in prior art reed relays is to condition the final relay with varying temperatures. Such methods attempt to bring the thermal characteristics of the thermoset material or the potting compound into equilibrium with the thermal characteristics of the switch. However, such methods are expensive since they add an additional step to the process of manufacturing a reed relay and they are also generally ineffective.

Another method of remedying some of these deficiencies in prior art reed relays is to mould a thermoplastic material rather than a thermoset material around the coil-bobbin-switch assembly and to select the thermoplastic material so that its temperature characteristics match those of the switching device. However, such relays can not operate over the same temperature range as relays produced using thermoset material or potting compounds.

Another problem with prior art reed relays is that the thermoset material, thermoplastic material, or potting compound does not flow evenly and predictably through the bobbin's central aperture and around the switching device. Rather than entirely encapsulating the switching device, the thermoset material, thermoplastic material, or potting compound tends to leave "voids" or unfilled regions around the external surface of the switching device. Such voids affect the operating characteristics of a reed relay, and since the voids tend to occur randomly in any given reed relay, it is difficult to produce a large quantity of reed relays that all provide the same operating characteristics.

Another problem with prior art reed relays is that it is difficult to entirely automate the process of manufacturing them, since the step of inserting the switching device into the central aperture of the bobbin must normally be performed manually.

Yet another problem with prior art reed relays is that the start and finish ends of the coiled-wire typically terminate on the bobbin terminals which are soldered or welded directly to the leadframe. A force applied on these bobbin terminals, which can occur during the assembling process or during the coil-to-leadframe welding process, can result in stressing the start and finish ends of the wire. This stressed wire is weakened and can break when additional stresses are generated by the external environment.

SUMMARY OF THE INVENTION

It is an object of this invention to overcome the aforementioned drawback by providing a method of realizing a moulded bobbin-switch sub-assembly that can be used in various relay assemblies.

Another object of the invention is to provide a moulded bobbin-switch sub-assembly for use in manufacturing various types of electromagnetic or reed relay switches method.

Yet another object of this invention is to provide a method of manufacturing relay devices using a bobbin-switch sub-assembly according to the invention.

These and other objects are accomplished by an assembly including a magnetically actuated switch and a bobbin. The switch defines an exterior surface and includes two terminals, and the switch provides a relatively low electrical resistance path between the two terminals when closed and provides a relatively high electrical resistance path between the two terminals when open. The bobbin defines an interior surface and an exterior surface, and the bobbin is disposed around the switch so that the bobbin interior surface contacts substantially all of a predetermined portion of the switch exterior surface. The switch exterior surface may be defined by a glass envelope typically used to hermetically seal the conductive components of the switch. In one aspect of the invention, the bobbin is fabricated from material having a coefficient of thermal expansion that is substantially equal to the coefficient of thermal expansion of the switch exterior surface.

The method and structure of the invention and the moulded bobbin-switch sub-assembly according to this invention are set forth in the appended claims.

BRIEF DESCRIPTION OF THE DRAWINGS

FIG. 1 shows a leadframe which may be used to produce a sub-assembly according to the invention;

FIG. 2 represents the assembly of a switch welded to the leadframe shown in FIG. 1;

FIG. 3 shows the assembly of FIG. 2 with a bobbin moulded around the switch;

DESCRIPTION OF AN EXEMPLARY EMBODIMENT OF THE INVENTION

Figure 1:
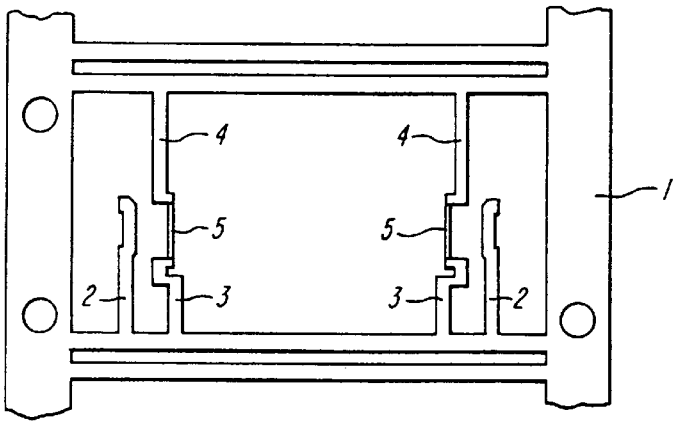
FIGS. 1 to 3 illustrate the steps of manufacturing a moulded bobbin-switch sub-assembly in accordance with the invention.
Figure 2:
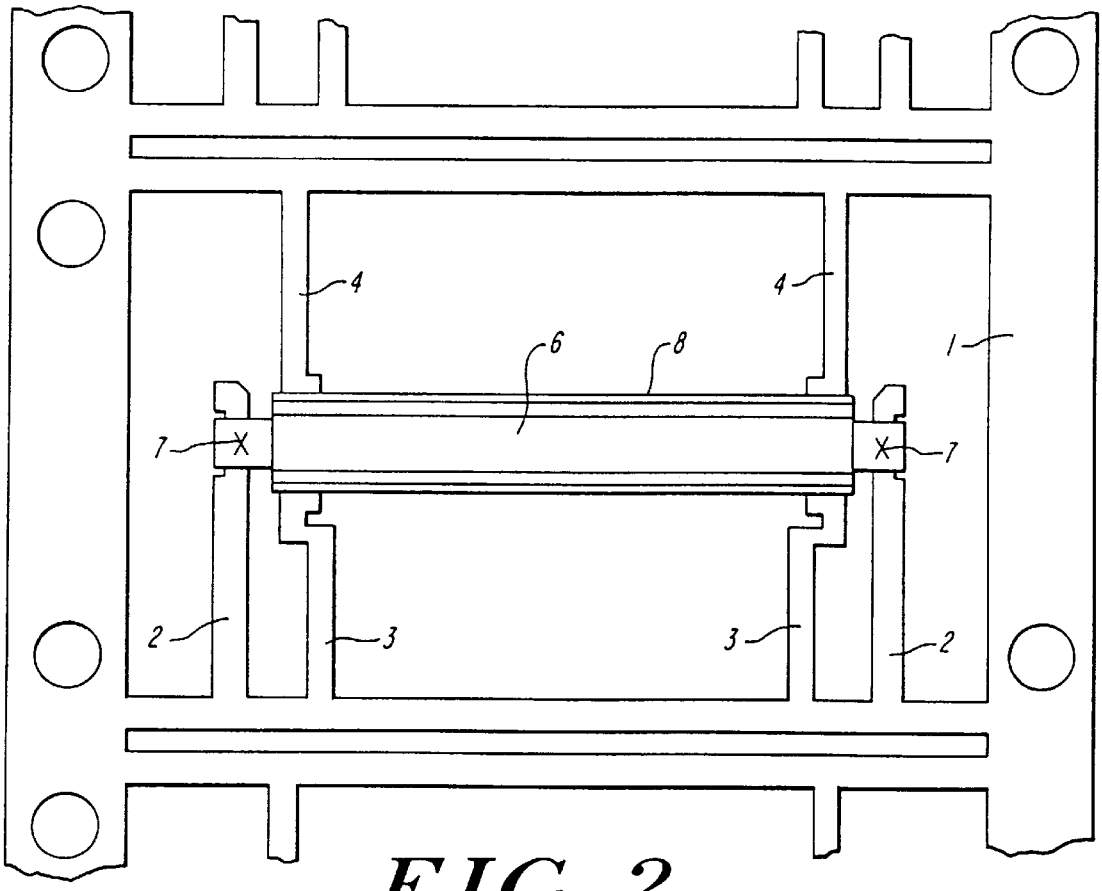
Figure 3:
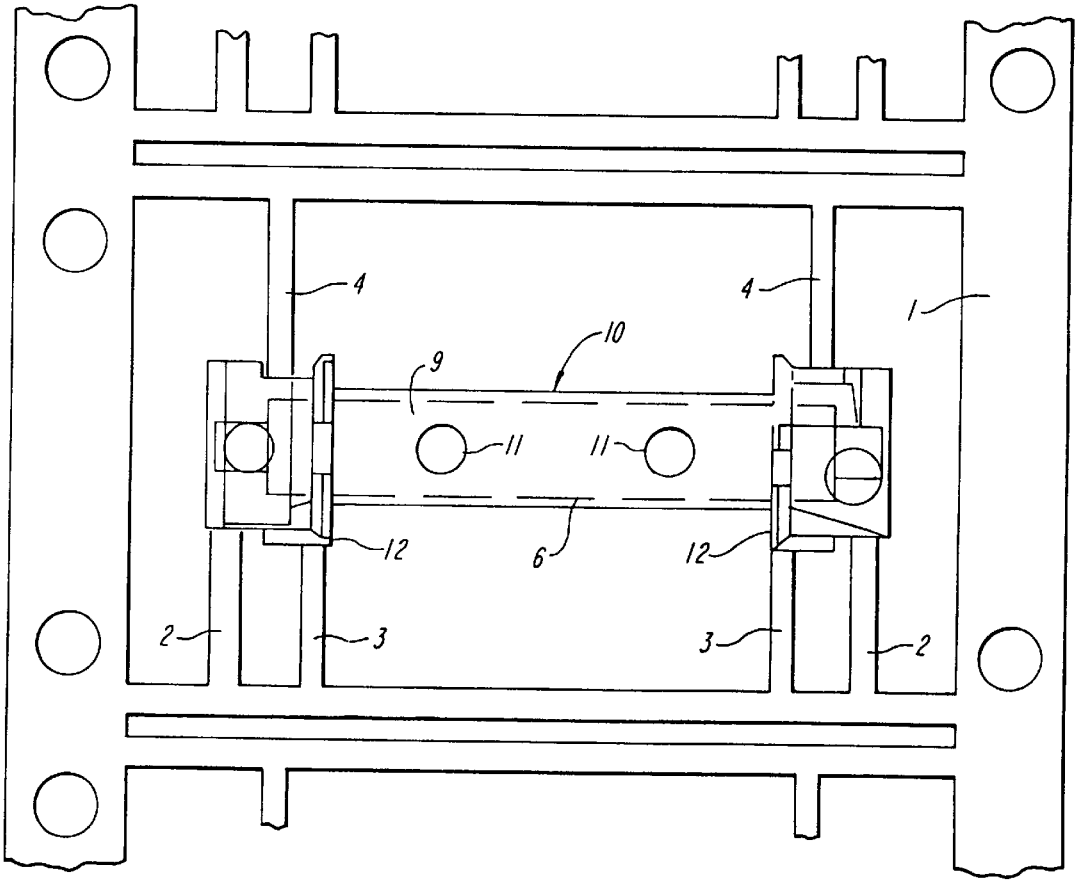
Figure 4A:
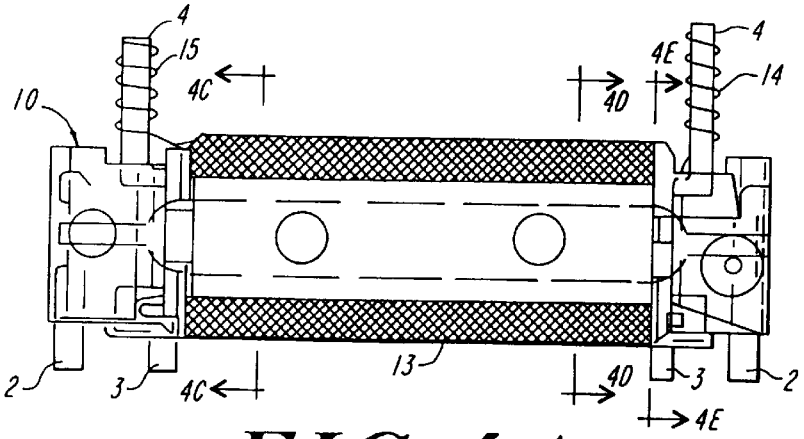
FIG. 4 shows the assembly of FIG. 3 with a coil wound on the bobbin.
Figure 4B:
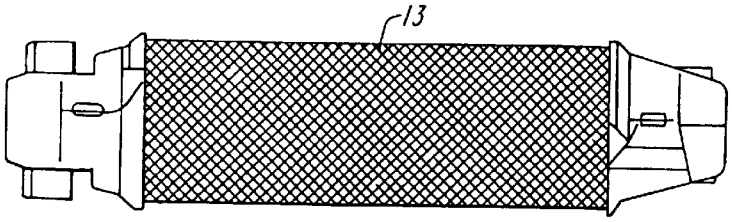
Figure 4C:
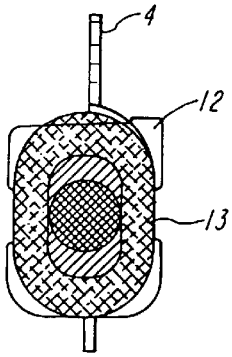
Figure 4D:
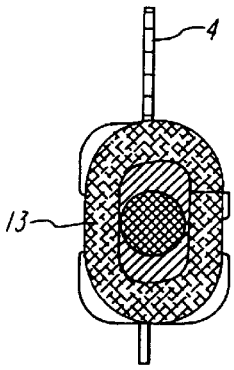
Figure 4E:
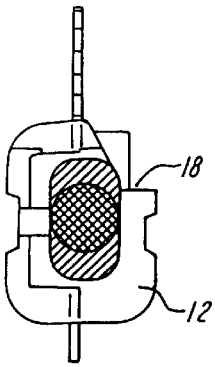
Figure 5A:
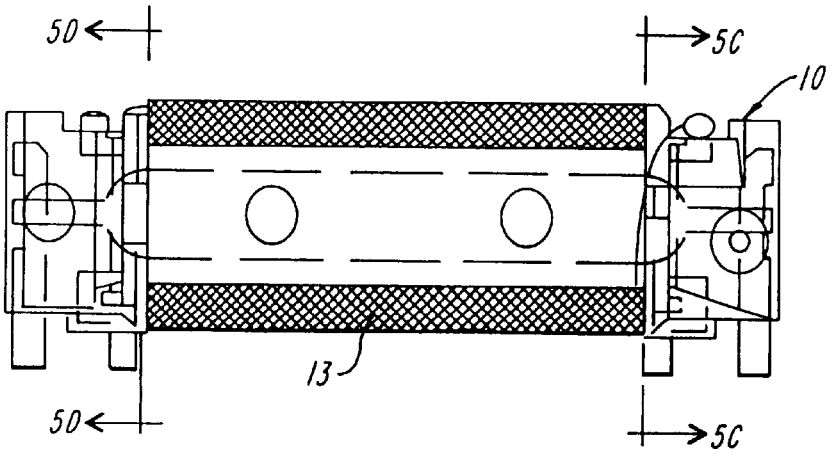
FIG. 5 shows the assembly of FIG. 4 after the coil terminals have been bended.
Figure 5B:
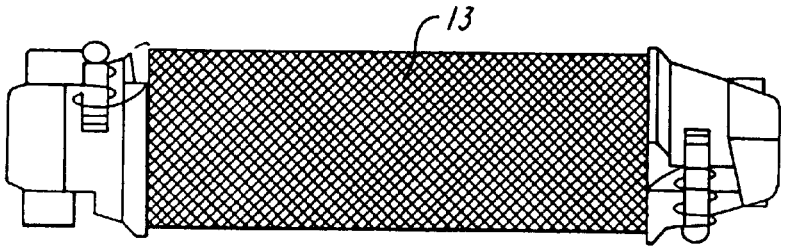
Figure 5D:
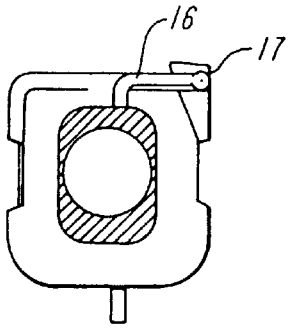
Figure 5C:
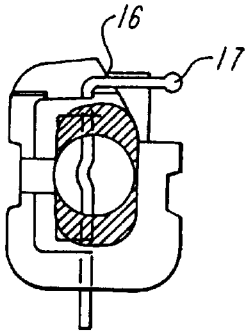

Referring to FIGS. 1 to 3 there is illustrated the manufacture of one preferred embodiment of a moulded bobbin-switch sub-assembly 10 (shown in FIG. 3) of the invention. FIG. 1 shows one embodiment of an internal leadframe 1 which may be used to produce one form of sub-assembly 10 according to the invention. Leadframe 1 includes two switch terminals 2, two coil terminals 3 and two additional coil terminals 4. The coil terminals 3 and 4 on the left side of frame 1 are electrically connected via a conductive segment 5, and similarly, the coil terminals 3 and 4 on the right side of frame 1 are also electrically connected via a conductive segment 5. Leadframe 1 is made e.g. of a FeNi alloy or Cu or Cu-alloy, or another magnetically or electrically conductive material. Using FeNi alloy helps to improve the magnetic path for the field generated by the coil. When using Cu or Cu-alloy, the electrical resistance of the signal path through the switch will be lower than when a FeNi alloy is used. The choice of the material for this frame depends on the application.

FIG. 2 shows a switch device 6 (for example of the type described in the above-referenced U.S. Pat. No. 4,769,622) having its ends 7 welded to the switch terminals 2 of internal leadframe 1. Switch 6 is mangetically actuated and provides a low electrical resistance path between its ends 7 when closed and provides a high electrical resistance path between its ends 7 when open. Switch 6 defines an external surface 8, and surface 8 may be defined by a glass envelope of the type typically used to hermetically seal the conductive elements of switch 6. The welds between switch ends 7 and switch terminals 2 are preferably performed with a laser so that these connections resist the high temperature of the reflow soldering process to which, as will be discussed in greater detail below, the bobbin-switch sub-assembly 10 may later be subjected. Terminals 3 and 4, and conductive segments 5 (shown in FIG. 1) do not make electrical contact with switch 6 and may or may not physically contact switch 6.

As shown in FIG. 3, a bobbin 9 is moulded around the switch 6 by means of injection moulding technology using thermoplastic material, e.g. Liquid crystal Polymer (LCP), to form the bobbin-switch sub-assembly 10. The thermoplastic material of bobbin 9 is preferably selected so that the thermal expansion characteristics of bobbin 9 closely match the thermal expansion characteristics of switch 6 (i.e., the thermal expansion characteristics of the external surface 8 of switch 6). One advantage of sub-assembly 10 is that bobbin 9 encapsulates, or "cocoons", switch 6 and thereby prevents any thermoset or potting compounds used in subsequent manufacturing steps from directly contacting switch 6. Sub-assembly 10 thereby avoids the problems associated with thermal stress which adversely affect prior art reed relays. Further, injection moulding bobbin 9 around switch 6 insures that bobbin 9 substantially entirely encapsulates switch 6 and prevents any void regions from randomly forming between switch 6 and bobbin 9. Sub-assembly 10 therefore avoids the performance variations associated with prior art reed relays, and large quantities of sub-assembly 10 may be produced that all provide substantially the same operating characteristics.

The position of switch 6 with respect to carrier frame 1 is preferably maintained during the injection moulding so that switch 6 is reliably centered within bobbin 9 of sub-assembly 10. As those skilled in the art will appreciate, it is desirable for switch 6 to be centered within bobbin 9 so that magnetic fields generated by a coil 13 (shown in FIG. 4) wrapped around bobbin 9 will reliably open and close switch 6. Since relatively high nozzle pressures (e.g., 300 pounds per square inch) are preferably used to inject the thermoplastic material used to form bobbin 9 into a mould (not shown) that surrounds switch 6, it is desirable for the mould to maintain the position of switch 6 during the injection moulding. If the position of switch 6 is not so maintained during the injection moulding, the switch 6 tends to exhibit a "wave-like" motion as a result of the flowing thermoplastic material and the switch 6 will not normally be centered within the bobbin. One method of maintaining the position of switch 6 during the injection moulding is to use a mould that provides four spring loaded pins that physically contact and maintain the position of switch 6. FIG. 3 shows a sub-assembly 10 produced using such a mould and sub-assembly 10 consequently defines four apertures 11 in bobbin 9, and each of the apertures 11 exposes part of the external surface of switch 6. FIG. 3 shows two of the four apertures 11, and if FIG. 3 shows a top view of sub-assembly 10 then the remaining two apertures 11 would be on the bottom of sub-assembly 10. In alternative embodiments of the invention, the pins in the mould may be withdrawn partway through the injection moulding after the position of switch 6 has been stabilized within bobbin 9 so that the apertures 11 are then filled in with additional thermoplastic material. Those skilled in the art will appreciate that other types of moulds (e.g., moulds providing more or fewer than four pins) may be used for forming bobbin 9 and for stabilizing the position of switch 6 during the injection moulding process. In any case, bobbin 9 defines an interior surface that contacts substantially all of a predetermined portion of the external surface 8 of switch 6. In some cases the predetermined portion may exclude selected regions such as is shown by apertures 11 in FIG. 3, and in other cases the interior surface of the bobbin 9 may contact substantially the entire external surface 8 of switch 6.

In the illustrated embodiment, bobbin-switch sub-assembly 10 provides a thermoplastic bobbin 9 that encapsulates switch 6. Bobbin 9 defines flanges 12 at both ends of assembly 10, and the flanges define a central recessed area about which a coil 13 (shown in FIG. 4) may be wound. Each of the switch terminals 2 extends into a respective flange 12 of bobbin 9 and makes electrical contact with a respective end of switch 6. Each of the coil terminals 3 and 4 also extend into, and are therefore fixed relative to, bobbin 9, and these terminals do not make electrical contact with switch 6.

The bobbin-switch sub-assembly 10 thus obtained may then be cut out of the internal leadframe 1 and presented for winding a coil 13 (FIG. 4) around the bobbin 9. After coil winding and terminating the start end 14 and the finish end 15 of the coil wire, these ends are jointed to the coil terminals 4 by arc welding or soldering using high temperature solder. After this operation, the terminals 4 are bended as shown at 16 in FIG. 5, whereby the stresses in the coilwire are released. Reference numeral 17 denotes the weld or solder at the ends of the coil wire.

The flanges 12 of the bobbin 9 are preferably provided with slots 18 in order to avoid that while terminating the coil wire ends to the coil terminals 4, the wire would be damaged by the sharp edges of the bobbin flanges 12.

The bobbin-switch sub-assembly 10 of the invention can be used for realizing various types of relay devices.

Figure 6:
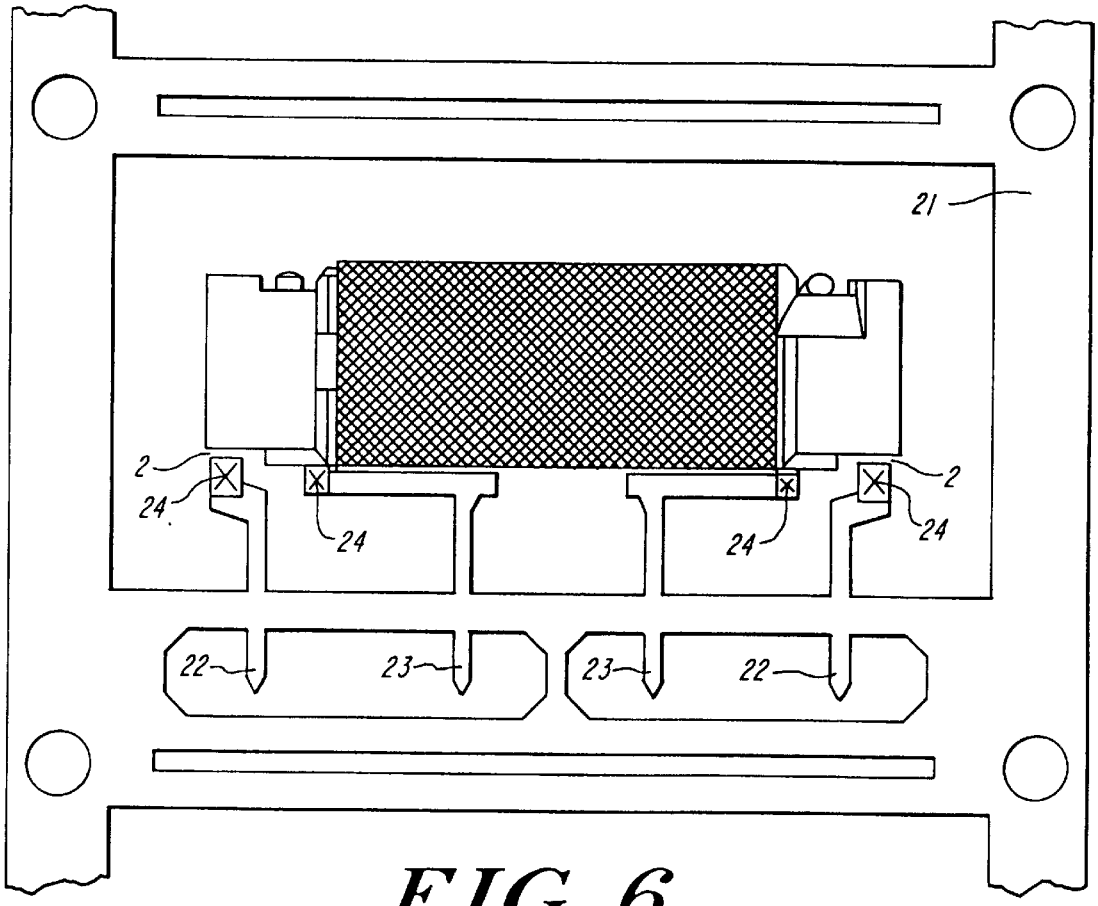
FIG. 6 shows the assembly of FIG. 5 when welded on a leadframe.
Figure 7:
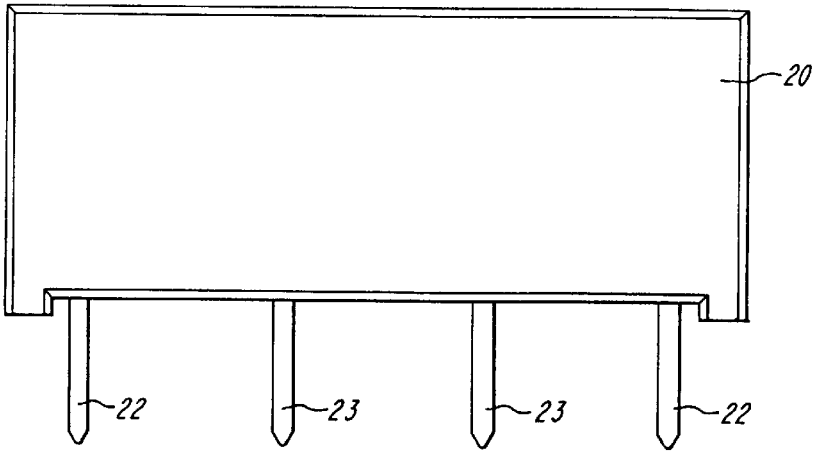
FIG. 7 illustrates a molded single-in-line relay assembled in accordance with the invention.
Figure 10:
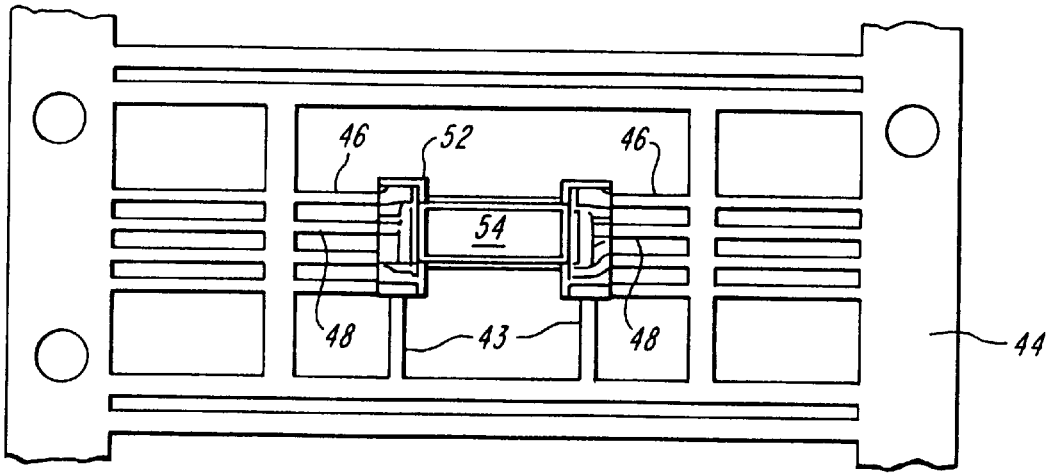
FIG. 10 shows a bobbin mould enclosing the assembly shown in FIGS. 8 and 9.

FIGS. 6 and 7 illustrate the realization of a single-in-line relay. The bobbin is first welded to a lead-frame 21 (FIG. 6). This leadframe 21 is preferably made of a FeNi alloy to improve the magnetic circuitry of the relay and is preferably SnPb plated. The leadframe 21 is formed with terminals 22 and 23. The switch terminals 2 and coil terminals 3 of the bobbin are welded to the leadframe terminals 22 and 23 respectively as shown at 24. The relay package 20 is then moulded by means of a transfermoulding process using a thermoset material and separated from the leadframe 21 to produce a single-in-line relay 20 (FIG. 6)

By virtue of injection moulding the bobbin 9 directly virtue of injection moulding the bobbin 9 directly around the switch 6, the device is protected from stresses induced by the thermoset material of the relay body 20, which has a higher coefficient of linear thermal expansion as compared to the thermoplastic material used for the bobbin 9.

In this design, the start and finish terminations of the coil wire prevent stress in the wire because the coil terminating terminals 4 are bended at 16 and the coil is indirectly connected to the leadframe terminals 23 via terminals 3.

Figure 9:
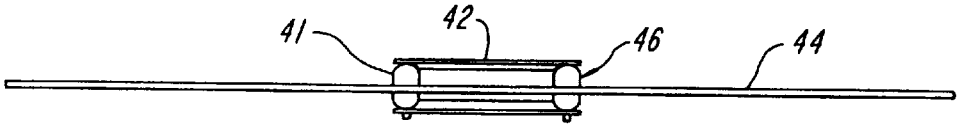
FIGS. 8 and 9 are cross sectional side and top views, respectively, showing a switch and RF shield welded to a leadframe.
Figure 8:
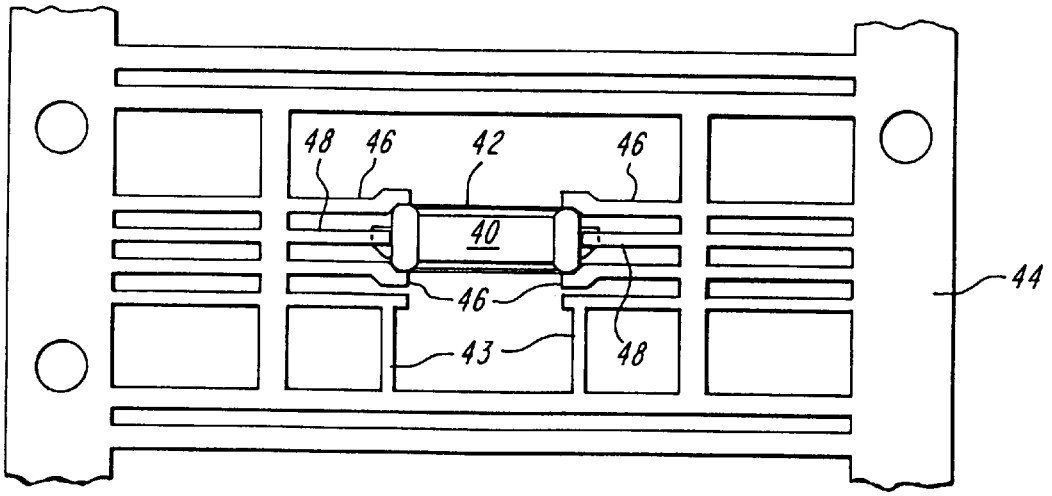

FIGS. 8, 9, 10 and 11 illustrate the realization of a surface mount relay for RF (radio frequency) applications. FIGS. 8 and 9 show cross-sectional side and top views, respectively, of a switch 40 and a shield 42 welded to a leadframe 44. Switch 40 includes an external envelope 41 that may be constructed of glass and that hermetically seals the conductive elements of the switch 40. Leadframe 44 provides four shield terminals 46 which are welded to shield 42, two switch terminals 48 which are welded to respective ends of the conductive elements of switch 40, and two coil terminals 43. Shield 42 is preferably fabricated from a conductive non-magnetic material such as copper and has the form of a tube that surrounds external envelope 41.

Figure 11:
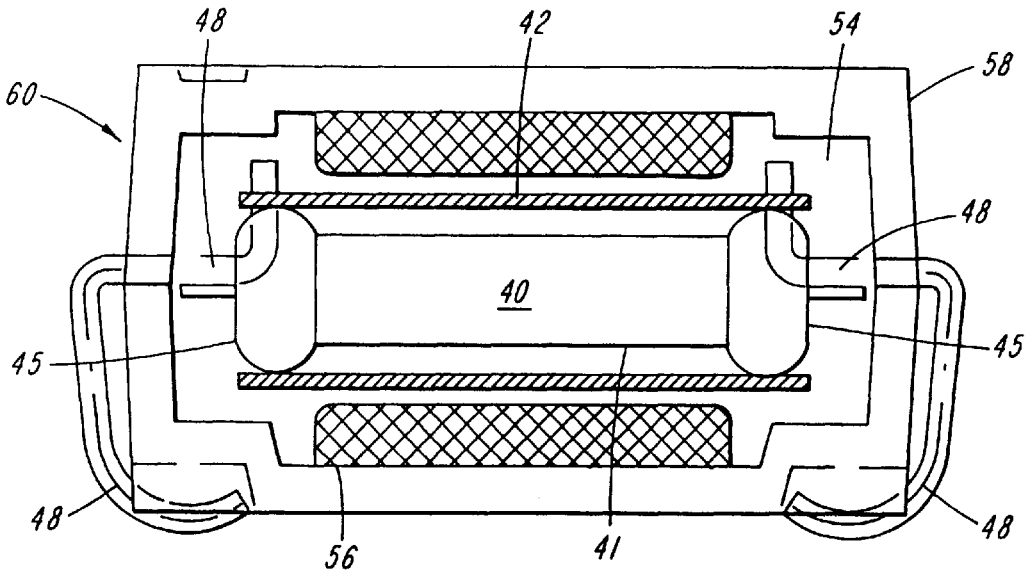
FIG. 11 shows one embodiment of a surface mount RF reed relay constructed according to the invention.

After switch 40 and shield 42 have been welded into leadframe 44, a mould 52 (shown in FIG. 10) is enclosed around switch 40 and shield 42, and a thermoplastic material is then injected into mould 52 to form a bobbin 54 that surrounds switch 40 and shield 42. The mould 52 preferably maintains the position of shield 42 and switch 40 during the injection moulding so that switch 40 and shield 42 are reliably centered within bobbin 54. As with assembly 10 (shown in FIG. 3) bobbin 54 encapsulates or cocoons switch 40 so that an internal surface of bobbin 54 contacts a predetermined portion of the external surface (or substantially the entire external surface) of switch 40, and the injection moulding of bobbin 54 substantially prevents random void regions from forming between the internal surface of bobbin 54 and the external envelope 41 of switch 40. FIG. 11 shows a completed surface mount RF reed relay 60 produced by winding a coil 56 around bobbin 54 and then moulding a thermoset material around bobbin 54 and coil 56 to form a relay body 58. Switch terminals 48 extend through the ends of relay body 58, and at least one of the shield terminals 46 (not shown) also preferably extends through an end of body 58 to facilitate electrically grounding shield 42. The coil terminals (not shown) also extend through the relay body to permit selective opening and closing of switch 40.

As shown in FIG. 11, external envelope 41 includes two enlarged regions 45 at both ends of the envelope 41, and the enlarged regions 45 are connected by a narrower central region, and the outer perimeter of the enlarged regions is greater than the outer perimeter of the central region. Shield 42 is preferably characterized by an inner perimeter that is slightly larger than the outer perimeter of the enlarged regions 45 so that (1) switch 40 fits within shield 42; (2) there is sufficient spacing between enlarged regions 45 and shield 42 to permit the thermoplastic material of bobbin 54 to flow into and to fill up the volume between the interior of shield 42 and the exterior of switch 40; and (3) the space between enlarged regions 45 and shield 42 is sufficiently small so that shield 42 constrains any motion of switch 40 that might be induced by the flow of thermoplastic material during the formation of bobbin 54 so that switch 40 is reliably centered within shield 42. Shield 42 additionally preferably provides sufficient rigidity so as to substantially maintain its shape during the formation of bobbin 54.

As those skilled in the art will appreciate, the characteristic impedance of switch 40 is a function of the dielectric constant of the thermoplastic material used to form bobbin 54 as well as the spacing between shield 42 and the conductive elements of switch 40. The characteristic impedance of reed relay 56 may therefore be controlled by selecting an appropriate geometry (e.g., diameter) for shield 42 and by choosing a thermoplastic material for bobbin 54 that is characterized by an appropriate dielectric constant. Since random void regions are substantially prevented from forming between the external envelope 41 and the internal surface of bobbin 54, a consistent and reliable amount of dielectric (i.e., thermoplastic) material is disposed between shield 42 and external envelope 41 in every reed relay 56 produced according to the invention. Further, since the mould 52 (shown in FIG. 10) maintains the position of shield 42 during the formation of bobbin 54, and since the shield 42 maintains the position of switch 40 during the formation of bobbin 54, the switch 40 is reliably centered within shield 42 with a very high degree of tolerance in every reed relay 56 produced according to the invention. The invention therefore provides a method for producing large quantities of reed relays that are all characterized by substantially the same impedance. This represents a substantial improvement over the prior art since in the prior art it was difficult to (1) maintain the shape of the shields during formation of the relay body; (2) maintain a desired spacing between the switch and the shields; and (3) prevent the random occurrence of void regions between the external surface of the switch and the relay body, and each of these factors made it difficult to produce large quantities of prior art relays that were all characterized by substantially the same impedance.

Figure 12:
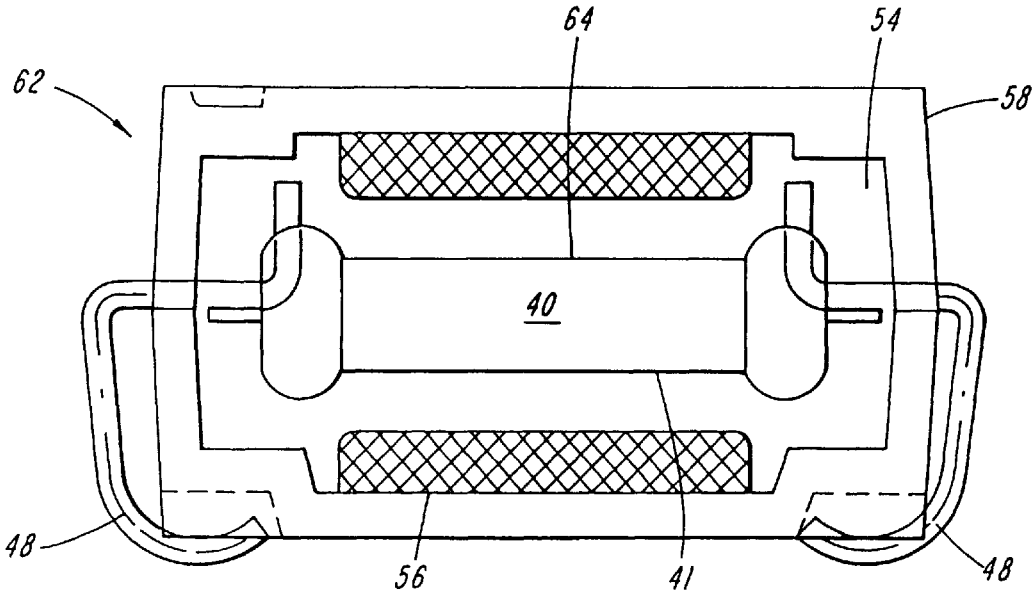
FIG. 12 shows another embodiment of a surface mount RF reed relay constructed according to the invention.

FIG. 12 shows another embodiment of a surface mount RF reed relay 62 constructed according to the invention. The construction of relay 62 is similar to that of relay 60 (shown in FIG. 11), however, rather than a copper tube, the shield for relay 62 includes a cladding 64 deposited directly onto the external envelope 41 of switch 40. In one preferred embodiment, external envelope 41 is a glass envelope and cladding 64 is formed by sputtering a layer of titanium onto the glass envelope 41, and by then depositing a layer of copper onto the titanium. As is described more fully in the above-referenced U.S. Pat. No. 4,769,622, titanium bonds with the glass and the copper adheres to the titanium better than copper would adhere to uncoated glass. After deposition of cladding 64, switch 40 may be welded or soldered into a leadframe so that the copper of cladding 64 electrically contacts the shield terminals of the leadframe. The subsequent steps of producing relay 62 are then essentially the same as used for relay 60 (shown in FIG. 11).

In relay 62 the shield 64 essentially defines the external surface of switch 40, and the space between shield 64 and the conductive elements of switch 40 is determined by the shape of envelope 41. Since bobbin 54 cocoons switch 40 and shield 64, large quantities of relays 62 may be produced according to the invention that are all characterized by the same impedance.

What is claimed is:

1. A method of producing a reed relay comprising:

providing a magnetically actuated switch having an enclosure that defines an exterior surface, said switch having two switch leads protruding from an interior region of the switch through the enclosure, the switch providing a relatively low electrical resistance path between the two switch leads were closed and providing a relatively high electrical resistance path between the two switch leads when open;

attaching each of first and second relay terminals to a respective one of the switch leads at a respective junction, each junction being located outside of said enclosure;

molding a thermoplastic material around the switch to form a bobbin that defines an interior surface and an exterior surface, the bobbin being disposed around the switch so that the bobbin interior surface contacts substantially all of a predetermined portion of the exterior surface of said enclosure and so that said bobbin encloses said junctions between the first and second relay terminals and the two switch leads; and winding a coil around the molded bobbin.

2. A method according to claim 1, wherein said molding step comprises a step of molding a liquid crystal polymer around the switch to form the bobbin.

3. A method according to claim 1, wherein said molding step comprises a step of injection molding the thermoplastic material around the switch to form the bobbin.

4. A method according to claim 3, wherein said molding step further comprises a step of maintaining a position of said switch during said injection molding step.

5. A method according to claim 1, further comprising the step of molding a thermoset material around the coil and bobbin.

6. A method according to claim 1, further comprising the step of potting a compound material around the coil and bobbin.

7. A method according to claim 1, further comprising a step of enclosing said switch within a metallic shield.

8. A method according to claim 1, further comprising a step of depositing a metallic cladding on said switch so that said cladding defines at least a portion of said switch exterior surface.

* * * * *